US007216951B2

(12) United States Patent
Garrana et al.

(10) Patent No.: US 7,216,951 B2
(45) Date of Patent: May 15, 2007

(54) PRINT CARTRIDGE ORDERING SYSTEM

(75) Inventors: Henry N. Garrana, Austin, TX (US); Bay Anthon, Austin, TX (US); John Hale, Copperas Cove, TX (US); Gary Lerhaupt, Austin, TX (US); Carol Truman, Austin, TX (US); Jeremy Staadeker, Austin, TX (US)

(73) Assignee: Dell Products L.P., Round Rock, TX (US)

( * ) Notice: Subject to any disclaimer, the term of this patent is extended or adjusted under 35 U.S.C. 154(b) by 341 days.

(21) Appl. No.: 10/843,785

(22) Filed: May 12, 2004

(65) Prior Publication Data

US 2005/0253887 A1 Nov. 17, 2005

(51) Int. Cl.
*B41J 29/393* (2006.01)
*G06Q 30/00* (2006.01)

(52) U.S. Cl. ..... 347/19; 705/26

(58) Field of Classification Search ..... 347/19; 705/26

See application file for complete search history.

(56) References Cited

U.S. PATENT DOCUMENTS

| | | | | |
|---|---|---|---|---|
| 4,791,281 | A | 12/1988 | Johnsen et al. | 235/383 |
| 5,008,519 | A | 4/1991 | Cunningham et al. | 235/383 |
| 5,640,495 | A | 6/1997 | Colbert et al. | 395/112 |
| 5,655,174 | A * | 8/1997 | Hirst | 399/27 |
| 5,815,657 | A | 9/1998 | Williams et al. | 395/186 |
| 5,937,225 | A * | 8/1999 | Samuels | 399/27 |
| 6,023,593 | A * | 2/2000 | Tomidokoro | 399/8 |
| 6,108,099 | A * | 8/2000 | Ohtani | 358/1.15 |
| 6,173,128 | B1 | 1/2001 | Saber et al. | 399/24 |
| 6,233,408 | B1 * | 5/2001 | Allen | 399/8 |
| 6,336,098 | B1 | 1/2002 | Fortenberry et al. | 705/14 |
| 6,356,874 | B1 * | 3/2002 | Øhrn | 705/6 |
| 6,510,291 | B2 | 1/2003 | Campbell et al. | 399/27 |
| 6,556,926 | B1 | 4/2003 | Haines | 702/34 |
| 6,571,071 | B2 | 5/2003 | Kanoshima et al. | 399/79 |
| 6,798,997 | B1 * | 9/2004 | Hayward et al. | 399/12 |
| 6,985,241 | B1 * | 1/2006 | Haines et al. | 358/1.14 |
| 6,985,877 | B1 * | 1/2006 | Hayward et al. | 705/27 |
| 7,013,092 | B2 * | 3/2006 | Hayward et al. | 399/24 |
| 7,062,451 | B1 * | 6/2006 | Dentel et al. | 705/26 |
| 2001/0004734 | A1 * | 6/2001 | Kudoh et al. | 705/26 |
| 2002/0186406 | A1 * | 12/2002 | Phillips et al. | 358/1.15 |
| 2003/0010818 | A1 * | 1/2003 | Asawaka | 235/379 |
| 2003/0043401 | A1 * | 3/2003 | Abel et al. | 358/1.14 |
| 2003/0046171 | A1 * | 3/2003 | Whale | 705/26 |
| 2003/0050865 | A1 * | 3/2003 | Dutta et al. | 705/27 |
| 2004/0111315 | A1 * | 6/2004 | Sharma et al. | 705/11 |
| 2004/0111699 | A1 * | 6/2004 | Rockwell | 717/103 |
| 2004/0125403 | A1 * | 7/2004 | Furst et al. | 358/1.15 |

* cited by examiner

*Primary Examiner*—Stephen Meier
*Assistant Examiner*—Rene Garcia, Jr.
(74) *Attorney, Agent, or Firm*—Hamilton & Terrile, LLP; Stephen A. Terrile

(57) ABSTRACT

A method for automatically ordering printer consumables which includes determining when a printer consumable is close to depletion and automatically ordering a replacement to the printer consumable based upon a plurality of criteria. The criteria includes the amount of consecutive time a consumer has been a member of a printer consumable subscription service and the number of printer consumables ordered by a consumer.

24 Claims, 4 Drawing Sheets

PRINT CARTRIDGE ORDERING SYSTEM

BACKGROUND OF THE INVENTION

1. Field of the Invention

The present invention relates to printers, and more particularly to ordering print cartridges for printers.

2. Description of the Related Art

As the value and use of information continues to increase, individuals and businesses seek additional ways to process and store information. One option available to users is information handling systems. An information handling system generally processes, compiles, stores, and/or communicates information or data for business, personal, or other purposes thereby allowing users to take advantage of the value of the information. Because technology and information handling needs and requirements vary between different users or applications, information handling systems may also vary regarding what information is handled, how the information is handled, how much information is processed, stored, or communicated, and how quickly and efficiently the information may be processed, stored, or communicated. The variations in information handling systems allow for information handling systems to be general or configured for a specific user or specific use such as financial transaction processing, airline reservations, enterprise data storage, or global communications. In addition, information handling systems may include a variety of hardware and software components that may be configured to process, store, and communicate information and may include one or more computer systems, data storage systems, and networking systems. Known printers are another example of an information handling system.

Printers often include consumables that become depleted with use and then need to be replaced. For example, laser printers typically include toner cartridges, both black and color, that have a limited print capacity. Also for example, ink jet printers typically include ink cartridges, both black and color, which have a limited print capacity. All these consumables need to be replaced with use, often more than once, during the life of the printer.

Many business and individuals need to print documents. In fact, the ability to print documents can be a critical requirement in many cases. Accordingly, printer owners place a high value on the functionality of their printers. Some businesses may own and operate a large number of printers. One challenge that can be encountered is ensuring that printers are available when needed. This involves ensuring that replacements to printer consumables are available when the printer consumable within the printer is depleted.

Some printer owners solve this problem by maintaining a local inventory of replacement printer consumables. To maintain the inventory, the printer owner may assign an employee with the task of ordering new printer consumables when needed. In addition, the business may assign an employee with the task of monitoring the printers to determine when consumables in the printer should be replaced and also to replace the consumables when needed. Unfortunately, this solution can be expensive and time consuming.

Additionally, some printer companies provide printers and printer consumables to customers via the mail and may not have a retail storefront presence. A consumer may ignore the automatic warning of "low ink" levels when generated. When the ink finally runs out, they can only order on-line and at best with next day delivery. With this type of supply chain, it becomes important to provide a printer customer with the forewarning of the need to replace a printer consumable before the consumable is depleted. If a customer waits until the printer consumable is already depleted, then the printer customer would be unable to use their printer until receiving a replacement consumable in the mail. The option of just running down to the store is not available.

It is known to provide coupons to encourage potential customers to purchase products. For example, U.S. Pat. No. 6,336,098 discloses electronic distribution and redemption of coupons via the Internet. U.S. Pat. No. 4,791,281 discloses a system for processing coupons which includes assembling multiple encoding and decoding of coupons. U.S. Pat. No. 5,008,519 discloses an electronically controller coupon redemption system.

Accordingly, it is desirable to provide an automatic print cartridge ordering system which alleviates the problem of running out of printer ink and the inability to access print cartridges locally.

SUMMARY OF THE INVENTION

In accordance with the present invention, an automatic print cartridge ordering system which alleviates the problem of running out of printer ink and the inability to access print cartridges locally is set forth. The system also provides a printer supplier with a revolving income base due to cartridge ordering.

An automatic print cartridge ordering system within a printer is implemented to enable consumers to automatically have ink ordered when ink levels get to a low state. The system, which is stored on non-volatile memory, understands whether the consumer would like ink automatically re-ordered when low, but also tracks secondary criterion which determine whether the customer has met a specific qualification to receive an additional discount on the cost of the replacement ink cartridge.

The system also includes a utility that interfaces with known printer technology that determines low levels of printer ink cartridges. The utility also includes the ability to automatically order from a printer supplier website according to a customer's setup. The system includes options such as automatic ordering based on average ink used and automatic warnings that ink should be ordered on average ink used. The system also tracks secondary criteria which are used to receive a further discount on replacement ink cartridges. Examples of secondary criteria include the number of consecutive months the consumer has been a member of the automatic ink subscription service and the number of consecutive ink cartridges the consumer has ordered while a member of the automatic ink subscription service. The system also includes an option for a referral program where consumers that refer other consumers are offered an even greater discount.

The system also includes a coupon incentive option. The coupon incentive option provides the consumer with coupons provide an incentive to reordering printer consumables when it is determined that the consumables are close to being depleted.

In one embodiment, the invention relates to a method for automatically ordering printer consumables which includes determining when a printer consumable is close to depletion and automatically ordering a replacement to the printer consumable based upon a plurality of criteria. The criteria includes the amount of consecutive time a consumer has been a member of a printer consumable subscription service and the number of printer consumables ordered by a consumer.

In another embodiment, the invention relates to a method for automatically ordering consumables which includes determining when a consumable is close to depletion and providing an incentive indicia when the consumable is close to depletion. The incentive indicia being generated by the device requiring the consumable.

In another embodiment, the invention relates to a method for electronic generation and redemption of coupons which includes the steps of generating, at a first location, a coupon in response to the detection of given parameters related to a first location, the coupon being subject to a set of issuance conditions, encoding the set of issuance conditions in a sequence of digits, performing an e-commerce transaction at a web site, including the transmission of the sequence of digits to claim a benefit related to the coupon, the web site being separately situated and operated from the first location, validating the compliance of the coupon benefit claim with the set of issuing conditions encoded in the sequence of digits, and authorizing a benefit as part of the e-commerce transaction when a coupon benefit claim received by the coupon redemption web site is validated and pertains to a product which is part of an e-commerce transaction.

In another embodiment, the invention relates to an apparatus for automatically ordering printer consumables which includes means for determining when a printer consumable is close to depletion and means for automatically ordering a replacement to the printer consumable based upon a plurality of criteria. The criteria includes the amount of consecutive time a consumer has been a member of a printer consumable subscription service and the number of printer consumables ordered by a consumer

BRIEF DESCRIPTION OF THE DRAWINGS

The present invention may be better understood, and its numerous objects, features and advantages made apparent to those skilled in the art by referencing the accompanying drawings. The use of the same reference number throughout the several figures designates a like or similar element.

DETAILED DESCRIPTION

Figure 1:
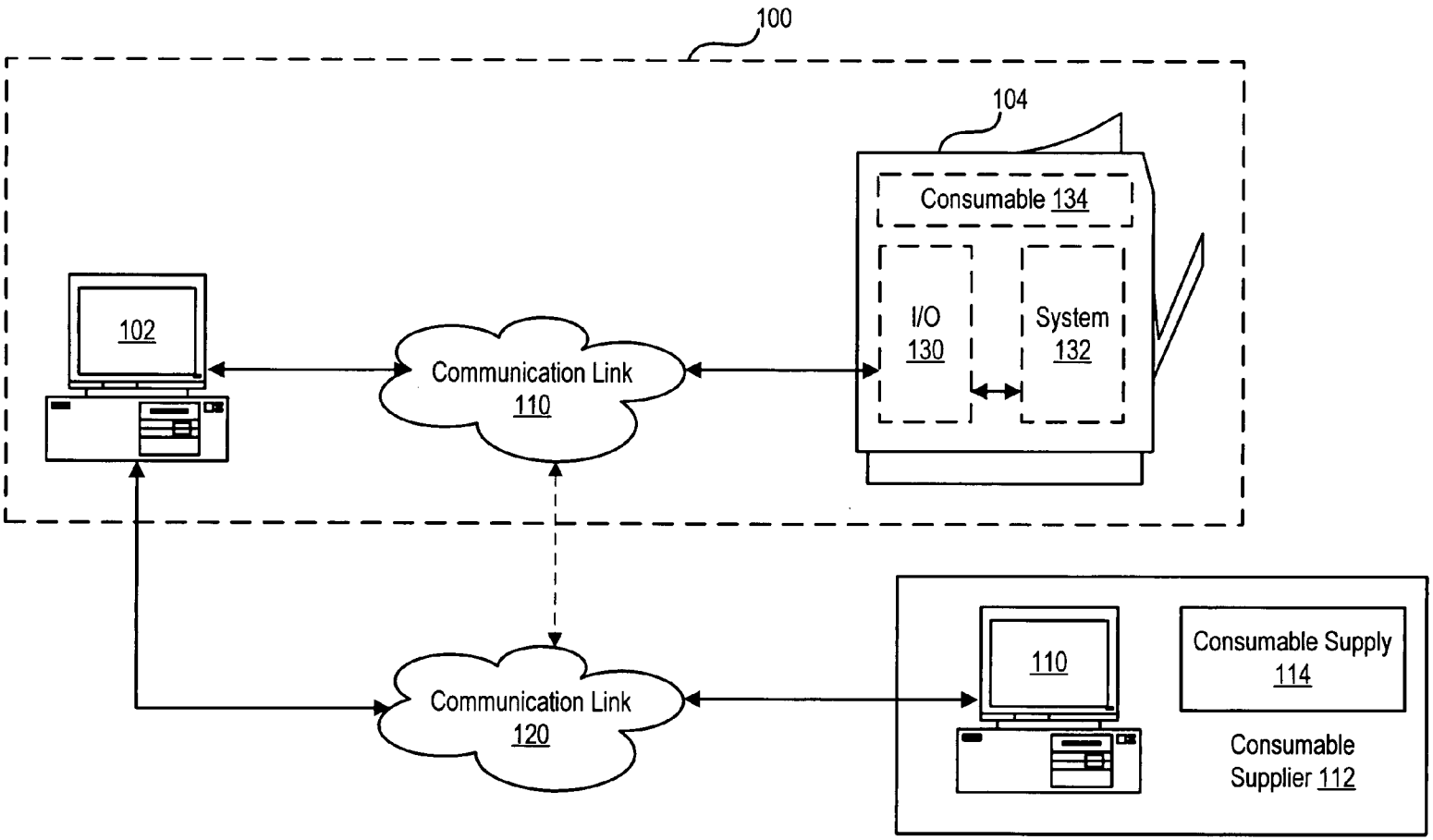
FIG. 1 shows a block diagram of an environment in which a printer is used.

Referring to FIG. 1, a block diagram of an environment in which a printer is used is shown. The environment includes a computer system 102 and a printer 104, coupled via a communication link 110. The communication link 110 might be a printer cable, a network connection or any other link which information is communicated with the printer 104.

The computer system 102 is also connected to another computer system (e.g., a vendor computer system) 110 via a second communication link 120. The second communication link 120 may be a telephone system or some other type of network, such as the Internet. In one embodiment, computer system 110 is owned and operated by a printer consumable supplier 112. In this example, the printer consumable supplier 112 provides printer consumables for use with the printer 104 from a supply 114 of printer consumables. The printer 104 may be directly coupled to the second communication link 120, in which case communication may occur between the printer and anything coupled to the second communication link 120.

The printer 104 includes an input output (I/O) port 130, a control system 132 and at least one printer consumable 134. The I/O port 130 facilitates communications between the printer 104 and other devices connected to the communications link 110. The control system 132 provides the printer 104 with certain control functionality. The control system 132 includes a processor and memory coupled to the processor. The print cartridge ordering system may be stored on either the memory of the printer or within the memory of the computer system 102.

The printer consumable 134 represents any component in the printer 104 that is subject to depletion through use of the printer 104. For example, the printer consumable 134 may be a toner cartridge or an inkjet cartridge, etc. The printer consumable supplier maintains a supply 114 of replacement printer consumables 134.

The computer system 102 generates a document in an electronic form and transmits the document (in the form of a print job) to the printer 104. The printer 104 receives the print job via the I/O port 130 and prints the document. Each time the printer 104 prints a document, the printer 104 transmits a pre-defined message to the computer 102.

It may be determined that the consumable 134 should be replaced when certain criteria are met. For example, it is assumed that the consumable 134 should be replaced each time the printer 104 prints "n" pages. When this event occurs, the control system 132 sets a consumable replacement indicator.

The status of the consumable replacement indicator may be determined by the computer 102. This is accomplished by the computer 102 transmitting a pre-defined query to the printer 104. The printer 104 responds to the query by generating a response indicating whether the consumable replacement indicator is set.

For purposes of this disclosure, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, an information handling system may be a personal computer, a network storage device, or any other suitable device and may vary in size, shape, performance, functionality, and price. The information handling system may include random access memory (RAM), one or more processing resources such as a central processing unit (CPU) or hardware or software control logic, ROM, and/or other types of nonvolatile memory. Additional components of the information handling system may include one or more disk drives, one or more network ports for communicating with external devices as well as various input and output (I/O) devices, such as a keyboard, a mouse, and a video display. The information handling system may also include one or more buses operable to transmit communications between the various hardware components.

Figure 2:
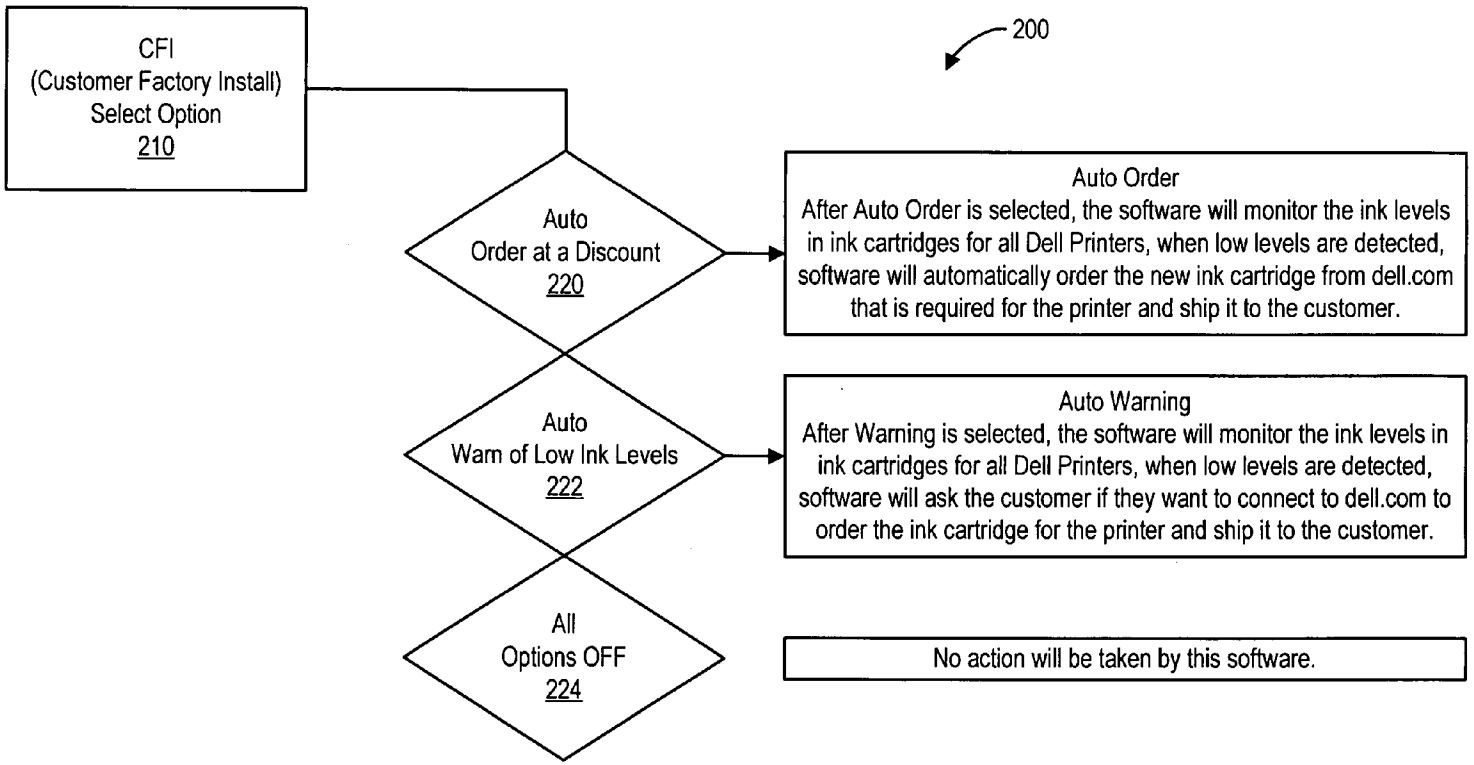
FIG. 2 shows a flow chart of the operation of a print cartridge ordering system.

Referring to FIG. 2, the print cartridge reordering system 200 includes a plurality of user selectable options. For example, these options can include whether to enable automatic reorder of print consumables and whether to automatically warn of low ink levels, or whether to disable all options within the printer.

In operation, during a customer factory installation at step 210, options may be selected by a customer and the printer is configured at the factory to reflect the options selected by the customer. More specifically, an automatic order at discount option may be selected at step 220. An automatic warning of low ink levels may be selected at step 222, or an all options off option may be elected at step 224.

When the automatic order at discount option is selected, software within the printer 104 monitors ink levels within the printer consumable. When a low level is detected, the software automatically orders a new ink cartridge from the printer supplier. The supplier receives the order and ships the replacement cartridge to the printer owner.

When the automatic warning option is selected, software within the printer 104 monitors ink levels of the ink cartridges. When a low level is detected, the software asks the printer customer if they want to connect to the printer supplier web site to order a replacement cartridge. If so, then the customer is automatically connected to the printer supplier web site, and when the printer supplier receives the order, it ships the replacement cartridge to the customer. When the all options off option is selected, then no action is taken by the software within the printer 104.

Figure 3:
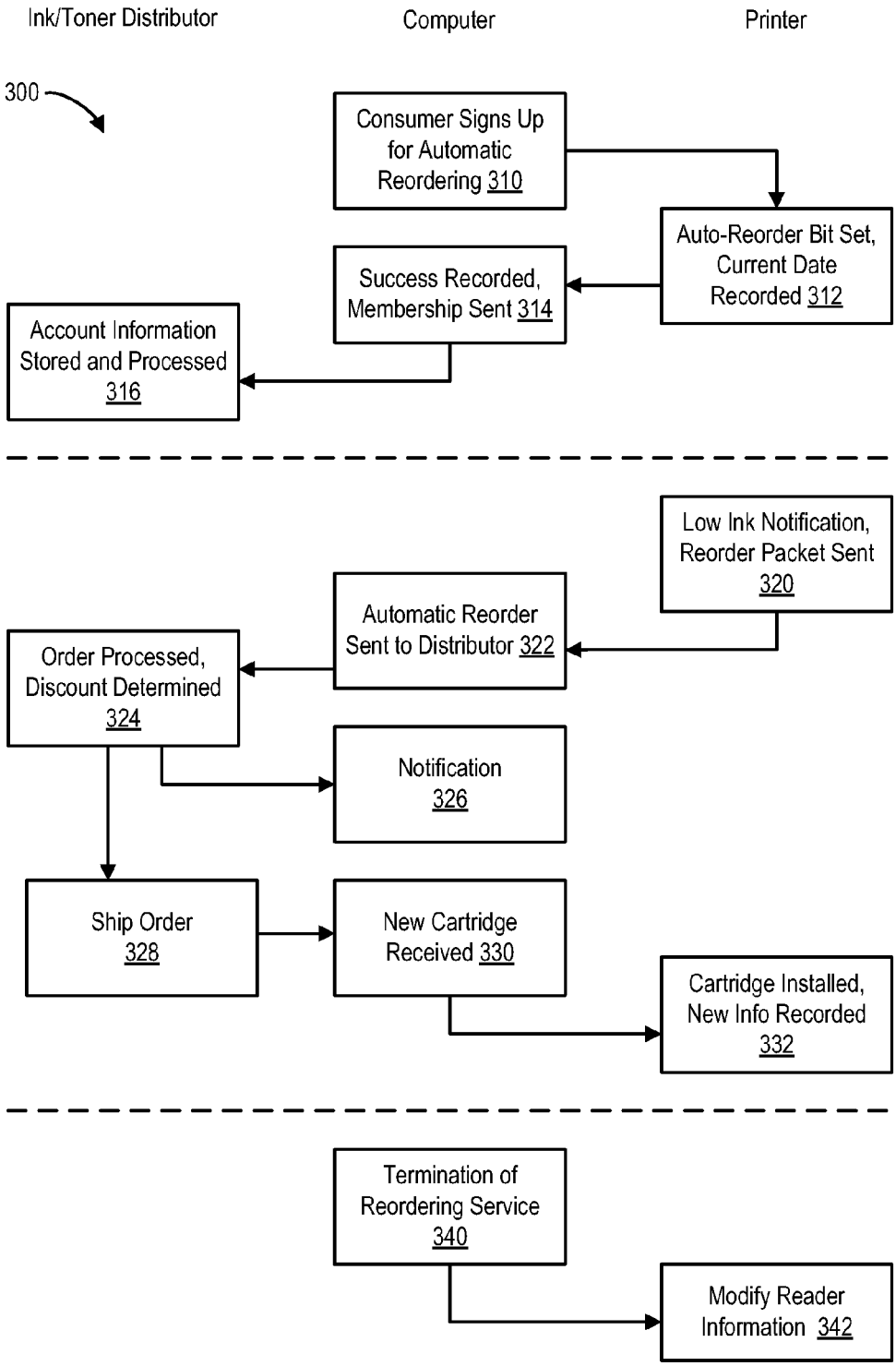
FIG. 3 shows a flow chart of the operation of an automatic reordering process.

Referring to FIG. 3, a flow chart of the operation of an incentivized automatic reordering process portion 300 of the cartridge reordering system is shown. More specifically, by providing a system in which a customer is rewarded further for consecutive and uninterrupted membership within the ink subscription service, the likelihood that the customer will become a member of this automatic reordering service increases. Because of this increase in participation, the consumable supplier 112 employing the system may better manage the ink recurring revenue stream. Thus, the printer supplier is able to offer discounts for those consumers who have met the specified criteria.

Implementation of data collection occurs within the hardware of the printer 104. The consumer initially signs up for the service with software on the consumer's computer 102 at step 310. This software alerts the printer consumable supplier 112 to the consumer's subscription as well as setting information within the printer 104 to indicate to the printer 104 that the printer 104 is configured for automatic reordering at step 312. The date of when the automatic reordering was first set is also recorded. Upon successfully recording the information, membership information is provided to the customer at step 314. The account information is also stored and processed at the consumable supplier at step 316.

When ink level is determined to be low (i.e., determined to be below a predefined level of depletion), the printer 104 sends notification to the computer at step 320. The notification includes a reorder packet of information. The reorder packet of information includes information about how long the printer 104 had automatic reorder bits set as well as how many cartridges have been replaced since the automatic reorder bits have been set. The automatic reorder information is then provided to the consumable supplier at step 322. The order is processed by the consumable supplier and depending on the criteria, the consumable supplier 112 determines whether to enable discounting at step 324. When the order is processed, the consumable supplier 112 generates an email, or other form of notification, to the consumer at step 326. The consumable supplier 112 ships the printer consumable at step 328 and the printer consumable is received by the consumer at step 330. When the printer consumable is installed into the printer, then the new information is recorded by the print cartridge ordering system at step 332. The consumer can then be determined to be eligible or non-eligible for further discounts on the ink which is being automatically reordered.

If the consumer decides later to discontinue the automatic reordering then the customer merely terminates the service at step 340. The automatic reorder information stored within the printer 104 is modified to indicate the termination of service at step 342. The modification of the reorder information may include clearing any reorder bits stored within the printer 104.

Thus, the incentivized automatic reordering process portion 300 encourages consumers to reorder printer consumables before the consumables are completely depleted. For example, the consumable supplier 112 might encourage consumers to register for the automatic reordering system so that the consumers receive new cartridges when their ink gets to the 10% full level. All members of the automatic reordering service would receive a 5% discount. However, if the consumer has been an uninterrupted member of the server for 6 months or have had 3 cartridges automatically reordered while in the program, then the consumer would be eligible for a 10% discount on cartridges. Further, if the consumer referred someone when a member of the service, the consumer would be eligible for a one-time 50% discount on a cartridge. By utilizing such a system, the printer supplier not only enters into a stable recurring revenue stream, but also encourages this revenue stream increase via a membership program.

Figure 4:
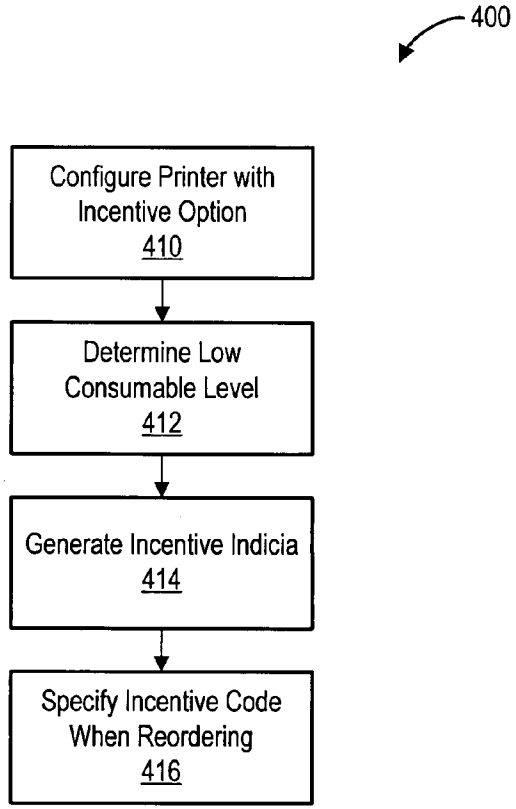
FIG. 4 shows a flow chart of the operation of an incentive based reordering process.

Referring to FIG. 4, the operation of an incentive based reordering process 400 is shown. By providing the consumer with an incentive to order replacement consumables early and not waiting until the last minute can provide increased customer satisfaction. Earlier orders lead to better consumer experiences and earlier sales for the printer supplier.

When using an incentive based reordering portion of the cartridge reordering system, a printer 104 is configured at step 410 to include an incentive based reordering portion 400. Thus, during operation of the printer 104, when the automatic warning of "low ink" levels is generated at step 412, an incentive indicia is generated at step 414. The incentive indicia includes a companion dated message offering a discount for orders placed within a limited time after the automatic warning of "low ink" levels is generated. The indicia further includes information indicating that the discount will not offered on any subsequent automatic warnings of "low ink" levels. Additionally, the dated message can include a discount code that imbeds the date the message is first generated to reduce fake claims for discounts.

To obtain the discount, the order must specify the discount code generated by that first warning message as determined by step 416. The consumable supplier 112 reviews the discount code for validity and notifies the consumer if the discount is valid.

More specifically, in one embodiment, the incentive based reordering process provides for electronic generation and redemption of coupons. With the electronic generation and redemption of coupons, a coupon is generated at a first location in response to detection of given parameters related to the first location. The coupon is subject to a set of issuance conditions. The set of issuance conditions are encoded as a sequence of digits. Next an e-commerce transaction is preformed at a web site; the transaction includes transmission of the sequence of digits to claim a benefit related to the coupon. The web site is separately situated and operated from the first location. Next compliance of the coupon benefit claim is validated with the said set of issuing conditions encoded in said sequence of digits. Next, a benefit is authorized as part of the e-commerce transaction when a coupon benefit claim received by the coupon redemption web site is validated and pertains to a product which is part of the e-commerce transaction. The given parameters relate to a sensed condition related to the operability of a device and specifically, the device is a printer and the sensed condition relates to a low ink supply.

OTHER EMBODIMENTS

The present invention is well adapted to attain the advantages mentioned as well as others inherent therein. While the present invention has been depicted, described, and is defined by reference to particular embodiments of the invention, such references do not imply a limitation on the invention, and no such limitation is to be inferred. The invention is capable of considerable modification, alteration, and equivalents in form and function, as will occur to those ordinarily skilled in the pertinent arts. The depicted and described embodiments are examples only, and are not exhaustive of the scope of the invention.

For example, an option to encourage recycling of printer consumables may be added to the reordering process by providing a return mechanism (such as a return envelope) when a new printer consumable is provided to the customer. Recycling of the printer consumables may be further encouraged by providing an incentive (such as a discount on future printer consumable orders) when the printer consumable is returned to the printer consumable supplier.

For example, the above-discussed embodiments include software modules that perform certain tasks. The software modules discussed herein may include script, batch, or other executable files. The software modules may be stored on a machine-readable or computer-readable storage medium such as a disk drive. Storage devices used for storing software modules in accordance with an embodiment of the invention may be magnetic floppy disks, hard disks, or optical discs such as CD-ROMs or CD-Rs, for example. A storage device used for storing firmware or hardware modules in accordance with an embodiment of the invention may also include a semiconductor-based memory, which may be permanently, removably or remotely coupled to a microprocessor/memory system. Thus, the modules may be stored within a computer system memory to configure the computer system to perform the functions of the module. Other new and various types of computer-readable storage media may be used to store the modules discussed herein. Additionally, those skilled in the art will recognize that the separation of functionality into modules is for illustrative purposes. Alternative embodiments may merge the functionality of multiple modules into a single module or may impose an alternate decomposition of functionality of modules. For example, a software module for calling sub-modules may be decomposed so that each sub-module performs its function and passes control directly to another sub-module.

Consequently, the invention is intended to be limited only by the spirit and scope of the appended claims, giving full cognizance to equivalents in all respects.

What is claimed is:

1. A method for automatically ordering printer consumables comprising:

determining, via an information handling system, when a printer consumable is close to depletion;

automatically ordering a replacement to the printer consumable based upon a plurality of criteria via the information handling system, the criteria including an amount of consecutive time a consumer has been a member of a printer consumable subscription service and a number of printer consumables ordered by a consumer.

2. The method of claim 1 wherein:

the determining when a printer consumable is close to depletion is based upon an average usage of the printer.

3. The method of claim 1 wherein:

the determining when a printer consumable is close to depletion is based upon an actual usage of the printer.

4. The method of claim 1 further comprising:

discounting a cost of the printer consumable based upon the plurality of criteria.

5. The method of claim 1 further comprising:

providing the automatic ordering via a reorder subscription service.

6. The method of claim 5 further comprising:

rewarding a customer for consecutive and uninterrupted membership in the reorder subscription service.

7. The method of claim 1 further comprising:

providing an incentive indicia when the printer consumable is close to depletion, the incentive indicia being generated by the printer.

8. The method of claim 7 wherein:

the incentive indicia includes a date indication, the date indication indicating that the incentive indicia is only available for a preset amount of time.

9. A method for automatically ordering consumables comprising:

determining when a consumable is close to depletion;

providing an incentive indicia when the consumable is close to depletion, the incentive indicia being generated by a device requiring the consumable; and, providing the automatic ordering via a reorder subscription service.

10. The method of claim 9 wherein:

the consumable includes a printer consumable.

11. The method of claim 9 wherein:

the determining when the consumable is close to depletion is based upon an average usage of a device consuming the consumable.

12. The method of claim 9 wherein:

the determining when the consumable is close to depletion is based upon an actual usage of a device consuming the consumable.

13. An apparatus for automatically ordering printer consumables comprising:

means for determining when a printer consumable is close to depletion;

means for automatically ordering a replacement to the printer consumable based upon a plurality of criteria, the criteria including an amount of consecutive time a consumer has been a member of a printer consumable subscription service and a number of printer consumables ordered by a consumer.

14. The apparatus of claim 13 wherein:

the determining when a printer consumable is close to depletion is based upon an average usage of the printer.

15. The apparatus of claim 13 wherein:

the determining when a printer consumable is close to depletion is based upon an actual usage of the printer.

16. The apparatus of claim 13 further comprising:

means for discounting a cost of the printer consumable based upon the plurality of criteria.

17. The apparatus of claim 13 further comprising:

means for providing the automatic ordering via a reorder subscription service.

18. The apparatus of claim 17 further comprising:

means for rewarding a customer for consecutive and uninterrupted membership in the reorder subscription service.

19. The apparatus of claim 13 further comprising:

means for providing an incentive indicia when the printer consumable is close to depletion, the incentive indicia being generated by the printer.

20. The apparatus of claim 19 wherein:

the incentive indicia includes a date indication, the date indication indicating that the incentive indicia is only available for a preset amount of time.

21. An apparatus for automatically ordering consumables comprising:

means for determining when a consumable is close to depletion;

means for providing an incentive indicia when the consumable is close to depletion, the incentive indicia being generated by the device requiring the consumable; and means for providing the automatic ordering via a reorder subscription service.

22. The apparatus of claim 21 wherein:

the consumable includes a printer consumable.

23. The apparatus of claim 21 wherein:

the determining when the consumable is close to depletion is based upon an average usage of a device consuming the consumable.

24. The apparatus of claim 21 wherein:

the determining when the consumable is close to depletion is based upon an actual usage of a device consuming the consumable.

* * * * *